US010527383B2

(12) United States Patent
Fulton

(10) Patent No.: US 10,527,383 B2
(45) Date of Patent: Jan. 7, 2020

(54) ADAPTIVE CROSSBOW SYSTEM

(71) Applicant: Crosman Corporation, Bloomfield, NY (US)

(72) Inventor: Andrew S. Fulton, Rochester, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 16/246,441

(22) Filed: Jan. 11, 2019

(65) Prior Publication Data

US 2019/0212091 A1 Jul. 11, 2019

Related U.S. Application Data

(60) Provisional application No. 62/615,959, filed on Jan. 11, 2018.

(51) Int. Cl.
*F41B 5/12* (2006.01)
*F41B 5/14* (2006.01)

(52) U.S. Cl.
CPC ..... *F41B 5/123* (2013.01); *F41B 5/12* (2013.01); *F41B 5/14* (2013.01)

(58) Field of Classification Search
CPC ..... F41B 5/12; F41B 5/123; F41B 5/14
See application file for complete search history.

(56) References Cited

U.S. PATENT DOCUMENTS

| | | | | |
|---|---|---|---|---|
| 3,949,729 | A * | 4/1976 | Pfotenhauer | F41B 5/12 124/20.3 |
| 4,996,968 | A * | 3/1991 | Hollingsworth | F41B 5/1403 124/24.1 |
| 8,141,547 | B2 * | 3/2012 | Bednar | F41C 23/16 124/25 |
| 8,794,224 | B2 * | 8/2014 | Bednar | F41B 5/0084 124/25 |
| 9,410,765 | B2 * | 8/2016 | Bednar | F41B 5/1469 |
| 2010/0012108 | A1 * | 1/2010 | Bednar | F41B 5/123 124/25 |
| 2015/0219420 | A1 * | 8/2015 | Bednar | F41B 5/1469 124/25 |

* cited by examiner

*Primary Examiner* — John A Ricci
(74) *Attorney, Agent, or Firm* — Lee & Hayes, P.C.

(57) ABSTRACT

Crossbow systems are provided a firing grip mounting shaped and adapted for use with one of a first firing grip adapter having a firing grip adapter mounting configured to mount to the firing grip adapter mounting and a second firing grip adapter having a second grip adapter mounting configured to mount to the firing grip adapter mounting and a foregrip mounting between the firing grip and the bow and having a foregrip mounting shaped and adapted for use with one of a first foregrip adapter having a first foregrip adapter mount configured to mount to the foregrip mounting and a second foregrip grip adapter having a second foregrip adapter mount configured to mount to the foregrip mounting. A first functional paradigm is enabled by the first firing grip and first foregrip and second functional paradigm is enabled by the second firing grip and the second foregrip.

6 Claims, 8 Drawing Sheets

ADAPTIVE CROSSBOW SYSTEM

CROSS-REFERENCE TO RELATED APPLICATIONS

This application claims the benefit of U.S. Provisional Application No. 62/615,959 filed Jan. 11, 2018.

STATEMENT REGARDING FEDERALLY SPONSORED RESEARCH OR DEVELOPMENT

Not applicable.

REFERENCE TO A "SEQUENCE LISTING"

Not applicable.

FIELD OF THE INVENTION

The present disclosure relates to crossbows and, more particularly, to an adaptive crossbow system.

BACKGROUND OF THE INVENTION

Crossbows are well known archery weapons typically fired from a hand held or shoulder mounted position. Contact between the user of a crossbow and the crossbow during aiming and firing of the crossbow typically happens at any of four points, a firing hand grip position, an aiming hand grip position, a cheek contact position and a shoulder contact position. Often crossbows provide predefined grips or contact surfaces at such points with the shape, position and composition of such contact points being fixedly defined for use by a generic user and having a generically pleasing feature set and appearance.

It will be appreciated that different users will have different needs and that what is needed is a crossbow that allows a user to readily adapt the crossbow system to their individual needs.

BRIEF SUMMARY OF THE INVENTION

Crossbow systems are provided. In one aspect of the invention a crossbow system has a barrel joined to a frame, a bow and string positioned along the barrel, a firing system having a firing grip area with a trigger and a string capture and fire control system positioned apart from the bow and string along the barrel, a firing grip mounting frame having a firing grip mounting shaped and adapted for use with one of a first firing grip adapter having a firing grip adapter mounting configured to mount to the firing grip adapter mounting and a second firing grip adapter having a second grip adapter mounting configured to mount to the firing grip adapter mounting and a foregrip mounting between the firing grip and the bow and having a foregrip mounting shaped and adapted for use with one of a first foregrip adapter having a first foregrip adapter mount configured to mount to the foregrip mounting and a second foregrip grip adapter having a second foregrip adapter mount configured to mount to the foregrip mounting. The first grip adapter has an interaction surface positioned relative to the firing grip mounting by a first grip adapter frame according to a first predetermined functional paradigm and the second grip adapter has an interaction surface positioned relative to the firing grip mounting by a second grip adapter frame according to a second predetermined functional paradigm; and the first foregrip adapter has an interaction surface positioned relative to the first foregrip adapter mount by a first foregrip adapter frame according to the first predetermined functional paradigm and the second foregrip adapter has an interaction surface positioned relative to the second foregrip adapter mount by a second foregrip adapter frame according to the second predetermined functional paradigm.

BRIEF DESCRIPTION OF THE SEVERAL VIEWS OF THE DRAWING(S)

DESCRIPTION OF THE INVENTION

Figure 1:
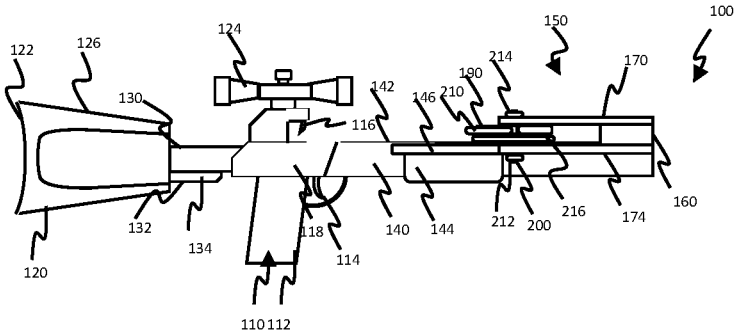
FIG. 1 is a right side view of one embodiment of a crossbow.
Figure 2:
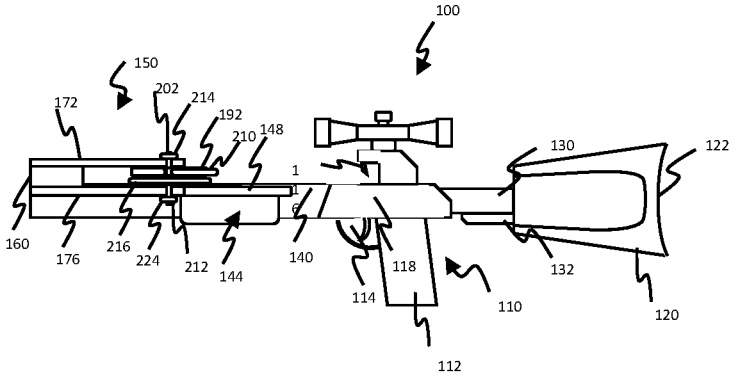
FIG. 2 is a left side view of the embodiment of FIG. 1.
Figure 3:
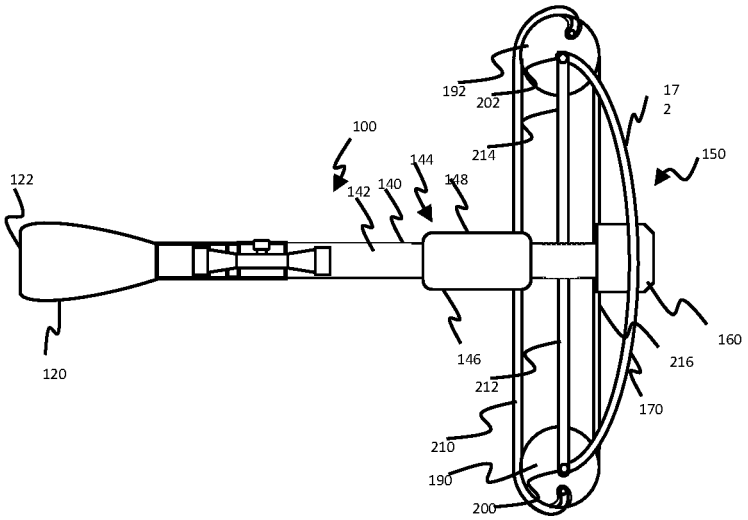
FIG. 3 is a top view of the embodiment of FIG. 1.

FIG. 1 shows a right side view, FIG. 2 shows a left side view and FIG. 3 shows a left side view of a crossbow 100. In the embodiment of FIGS. 1-3, crossbow 100 has a firing system 110 having a firing grip area 112, a trigger 114 and a string capture and fire control system 116 all joined by a frame 118. In crossbow 100, a buffer tube 130 extends rearward from frame 118 and a stock 120 is joined thereto. Stock 120 is shaped to allow a user to position a shoulder of a user against a butt 122 of stock 120 during aiming and firing of crossbow 100. In embodiments, stock 120 is shaped to receive at least a portion of buffer tube 130 at any of a range of positions along the length of buffer tube 130. This allows a user to adjust the distance between a shoulder of the user and firing grip area 112 within a range of distances that will allow comfortable use by a variety of different sized users. In the embodiment illustrated, buffer tube 130 has a ridge area 132 that provides surfaces 134 and 136 that are at least in part not aligned with an axial plane of a cylindrical cross section of buffer tube 130 and against which stock 120 can be mounted to prevent axial rotation of stock 120 about buffer tube 130. In embodiments ridge area 132 may be notched with stock 120 providing a fastener or other engagement device to interact with the notches to hold stock 120 at a preferred distance from firing grip area 112. Other mechanisms for ensuring a position of Barrel 140 extends between frame 118 and a bow 150. Bow 150 has a riser a 160 that links barrel 140 to at least a first limb 170 and a second limb 172. Optionally crossbow 100 may have additional limbs such as a third limb 174 and fourth limb 176.

In the example of FIGS. 1, 2 and 3, first limb 170 and third limb 174 are joined at their respective first ends end to and extend from riser 160 on the right side of crossbow 100 in a generally parallel fashion toward their respective second ends. Similarly in the example of FIGS. 1, 2, and 3, second limb 172 and fourth limb 176 are joined at a first end to and extend from riser 160 on the left side of crossbow 100 in a generally parallel fashion toward respective second ends thereof.

As is shown in FIGS. 1 and 3, a right side cam 190 is positioned between first limb 170 and third limb 174 proximate the second ends of first limb 170 and third limb 174 by a pin 200 or other structure assembled or otherwise provided between first limb 170 and third limb 174 and about which right side cam 190 can pivot. As is shown in FIGS. 2 and 3, a left side cam 192 is positioned between second limb 172 and fourth limb 176 proximate the second ends of second limb 172 and fourth limb 176 by a pin 202 or other structure assembled or provided between second limb 172 and fourth limb 176 and about which left side cam 192 can pivot. Although illustrated as having a circular shape, in FIGS. 1-3, right side cam 190 and left side cam 192 may take the form of a shaped cam.

As is shown in FIGS. 1-3, a bowstring 210 is provided having ends tied to cams 190 and 192. Tension in bowstring 210 is typically established by action of limbs 170, 172, 174, and 176 during assembly of crossbow 100. This is generally accomplished by applying a compressive force against limbs 170 and 174 and limbs 172 and 176 sufficient to drive the second ends of limbs 170 and 174 and second ends of limbs 172 and 176 toward each other until they reach a first range of relative positions.

Limbs 170, 172, 174 and 176 are shaped and made of materials that are elastically deformable within a range of elastic deformation and the first range of relative positions is defined so that the limbs are within a first portion of the range of elastic deformation.

Bowstring 210 and lateral support strings 212, 214 and 216 are installed with limbs 170, 172, 174 and 176 in the first range of positions. In this embodiment, bowstring 210 and lateral support string 216 are connected to right side cam 190 and to left side cam 192 while lateral support strings 214 216 are connected to limbs 170, 172, 174, and 176. Such connections are done so that limbs 170, 172, 174, and 176 will be held within the first range of positions after the compressive force is removed. Thereafter limbs 170, 172, 174, and 176 resist being held in this state and apply a first range of bias forces against bowstring 210.

Figure 4:
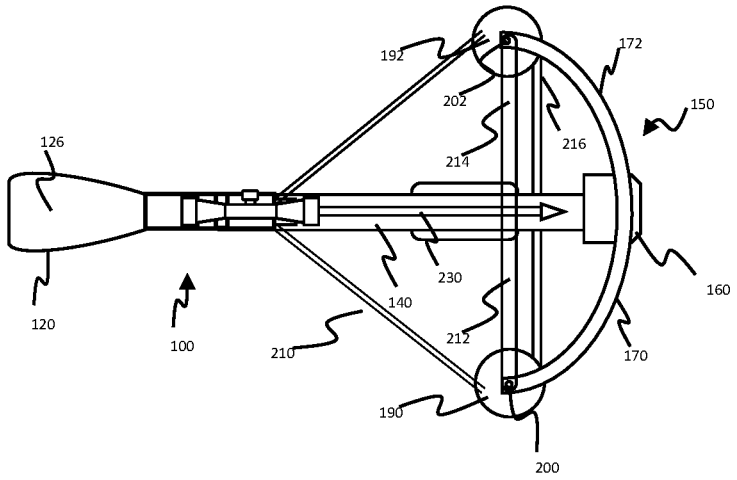
FIG. 4 is a top view of the embodiment of FIG. 1 with a bowstring captured by a fire control system.

To ready crossbow 100 for use, bowstring 210 is pulled from an initial configuration shown in FIGS. 1-3 to a firing configuration shown in FIG. 4. As is shown in FIG. 4, the drawing bowstring 210 from the initial position to the firing position causes further elastic deformation and bending of limbs 170, 172, 174 and 176 from the first range of elastic deformation to a second range of elastic deformation. Limbs 170, 172, 174, and 176 resist this greater amount of elastic deformation by applying even greater forces than are applied against bowstring 210 when bowstring 210 is in the initial configuration. Accordingly, kinetic energy exerted in moving bowstring 210 from the initial configuration to the firing configuration is stored as potential energy in limbs 170, 172, 174, and 176.

Once bowstring 210 is drawn to the firing configuration, fire control system 116 grips bowstring 210 and holds bowstring 210 in the firing configuration against the bias supplied by limbs 170, 172, 174 and 176. When bowstring 210 is securely engaged and controlled by fire control system 116, the user then loads an arrow 230 onto barrel 140 and positions arrow 230 such that when fire control system 116 releases bowstring 210, bowstring 210 will drive arrow 230 along barrel 140.

In operation, a user grasps crossbow 100 at firing grip area 112, and by a foregrip 144, which in this embodiment has flanges 146 and 148. The user typically may, if desired, place butt 122 of stock 120 against his or her shoulder and aim using a sighting system 124 that is aligned generally with a longitudinal axis of barrel 140 often this aiming process brings a user's cheek in contact with an upper portion 126 of stock 120.

Figure 5:
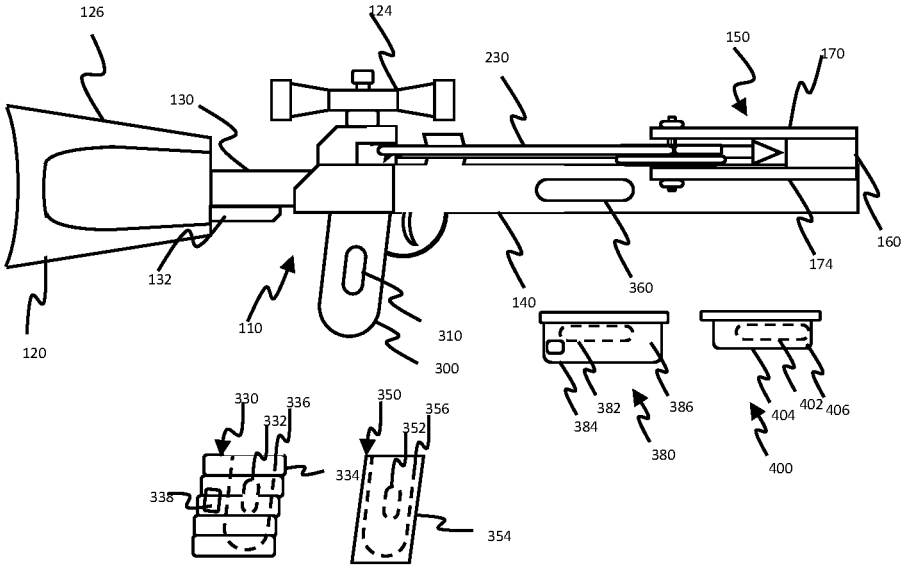
FIG. 5 is a right side view of the embodiment as shown in FIG. 4 with first and second grip adapters and foregrip adapters usable with the crossbow.
Figure 6:
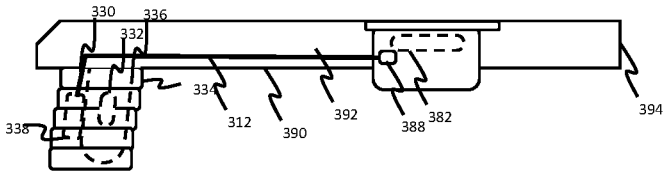
FIG. 6 shows another embodiment of a firing grip adapter and a foregrip adapter with a linkage therebetween.

FIG. 5 shows crossbow 100 having one embodiment of a firing grip mounting frame 300 with a firing grip mounting 310. As is shown in the embodiment of FIG. 5, firing grip mounting frame 300 and firing grip mounting 310 are shaped and adapted for use with either of a first firing grip adapter 330 and a second firing grip adapter 350.

In the embodiment of FIG. 5, first firing grip adapter 330 has a first firing grip adapter mount 332 configured to mount first firing grip adapter 330 to firing grip mounting 310 so that first firing grip adapter 330 and firing grip mounting frame 300 generally respond together when exposed to forces acting on first firing grip adapter 330. First firing grip adapter 330 has an interaction surface 334 positioned relative to first firing grip mount 302 by a first firing adapter frame 336 according to a first predetermined use paradigm.

In the embodiment of FIG. 5, second firing grip adapter 350 has a firing grip adapter mount 352 configured to mount second firing grip adapter 350 to firing grip mounting 310 so that second firing grip adapter 350 and firing grip mounting frame 300 generally move in concert in response to forces acting on second firing grip adapter 350. Second firing grip adapter 350 has an interaction surface 354 positioned relative to firing grip adapter mount 352 by a second firing adapter frame 356 according to a second predetermined use paradigm.

In the embodiment of FIG. 5, barrel 140 has a foregrip mounting 360 that is shaped and adapted for use with either of a first foregrip adapter 380 and a second foregrip adapter 400.

First foregrip adapter 380 has a first foregrip adapter mount 382 configured to mount first foregrip adapter 380 to foregrip mounting 210 so that first foregrip adapter 380 and barrel 140 generally move in concert in response to forces acting on first foregrip adapter 380. First foregrip adapter 380 has an interaction surface 384 positioned relative to first foregrip adapter mount 382 by a first firing adapter frame 386 according to the first predetermined functional paradigm.

Also in the embodiment of FIG. 5, a second foregrip adapter 400 has a foregrip adapter mount 402 that is configured to mount to foregrip mounting 360 so that second firing grip adapter 350 and firing grip mounting frame 300 generally move in concert in response to forces acting on second firing grip adapter 350. Second firing grip adapter 350 has an interaction surface 404 positioned relative to firing grip adapter mount 352 by a second firing adapter frame 406 according to a second predetermined functional paradigm.

First firing grip adapter 330 and first foregrip adapter 380 are configured so that a combination of crossbow 100, first firing grip adapter 330 and first foregrip adapter will 380 will allow use of crossbow 100 to support the first use paradigm, while second firing grip adapter 350 and second foregrip adapter 400 are configured cooperate to support the second use paradigm when used in combination with crossbow 100.

In embodiments, adapters 330, 350, 380, and 400 may be used to adapt crossbow 100 for different use paradigms by providing different ergonomics, shapes, textures, fit, identification, coloration, and camouflage elements according to the selection of adapters. For example, adapters 330 and 380 and 350 and 400 may be used to alter the function of crossbow 100 to support different use paradigms by adapting the range of motions or strengths required to use crossbow 100 so as to enable use of a common crossbow 100 between users of different sizes, strengths, and abilities. Such modifications may be used, for example, to enable more effective use of crossbow 100 by adult archers when crossbow 100 is combined with first adapters 330 and 380 and to enable more effective use of crossbow 100 by youth archers when joined to second adapters 350 and 400. In this example, it will be observed that second foregrip adapter 400 extends rearwardly from foregrip adapter mount 402 so that a user youth user with shorter grasp length will be able to grasp second foregrip adapter while gripping at a position that less extended than would be required using first foregrip adapter 380 which extends substantially forward of 382. Similarly, first firing grip adapter 330 is larger and can better fit the hand of an adult, while second firing grip adapter 350 is smaller and can serve to provide a better fit to a youth archer. In embodiments, a use paradigm may be supported at least in party by way of shifting a center of mass of crossbow 100 to better enable use of crossbow 100 by an adult and by a child.

Additionally, in embodiments, first grip adapter 330 and first foregrip adapter 380 can, for example, have surfaces that are supported by adapter frames 336 and 386 that provide little vibration dampening while also second firing grip adapter 350 and second foregrip adapter 400 may provide additional vibration dampening. In embodiments, crossbow 100, first firing grip adapter 330 and first foregrip adapter 380, second firing grip adapter 350 and second foregrip adapter 400 may be adapted to provide counter force mechanisms that act to dampen, modulate, redirect, or redistribute the forces experienced by a user of crossbow 100 as a product of recoil or other forces arising during firing crossbow 100. In embodiments, and without limitation, first adapter frames 336 and 386 and second adapter frames 356 and 406 may incorporate structures or materials the perform such functions. Also in embodiments, and without limitation, components of crossbow 100 such as firing grip mount 302 and foregrip mount 360 may be adapted to on their own or in cooperation with one or both of firing grip mounts 332 and 352 and foregrip mounts 382 and 402 perform such modulation, dampening and redirection of recoil and other forces associated with firing crossbow 100. In embodiments, such modulation, dampening, redistribution or redirection of vibration can be done in ways that at least in part have any of the effect of modulating, dampening, or redistributing or redirecting vibrations to allow a user to make more accurate use of crossbow 100, to use crossbow 100 with less grip strength, to lower a peak amount of recoil force experienced by a user per unit of time, to convert recoil energy into other forms of energy useful to a user of crossbow 100, or reduce audible noise that might attract unwanted attention and reactions from targets.

Similarly, one or both of first adapters 330 and 380 and second adapters 350 and 400 can be made to allow adaptation of crossbow 100 for use by differently abled archers. For example, and without limitation either or both of first adapters 330 and 380 and second adapters 350 and 400 can be defined to enable users different types of ability to successfully use crossbow 100.

In embodiments, first adapters 330 and 380 may combine to offer a first set of characteristics when combined with crossbow 100, while second adapters 350 and 400 may offer a second set of operational characteristics when combined with crossbow 100. For example, and without limitation, first adapters 330 and 380 may incorporate mountings or storage for crossbow accessories such as mountings for additional bolts, electronic devices, tools for cocking and de-cocking crossbow 100, other tools appropriate for a first use of crossbow 100, while second adapters 350 and 400 may provide or incorporate mountings or storage for crossbow accessories such as additional bolts of a different size, electronic devices, tools for cocking and de-cocking crossbow 100, other tools appropriate for a second use of crossbow 100.

In embodiments, first adapters 330 and 380 may include electronic, optical, electro-optical, mechanical or electro-mechanical or other crossbow accessory subsystems 338 and 388 respectively that are useful in combination with crossbow 100, while second adapters 350 and 400 may omit such a crossbow accessory system or provide components that when used in combination provide a different crossbow accessory system. For example, in one embodiment, first adapters 330 and 380 may combine to provide elements of a mechanical system to assist in cocking or de-cocking crossbow 100 such as a system that provides mechanical leverage to assist in rope cocking or de-cocking or may combine to provide elements of an electro-mechanical cocking systems such as a motorized cocking or de-cocking system.

Figure 7:
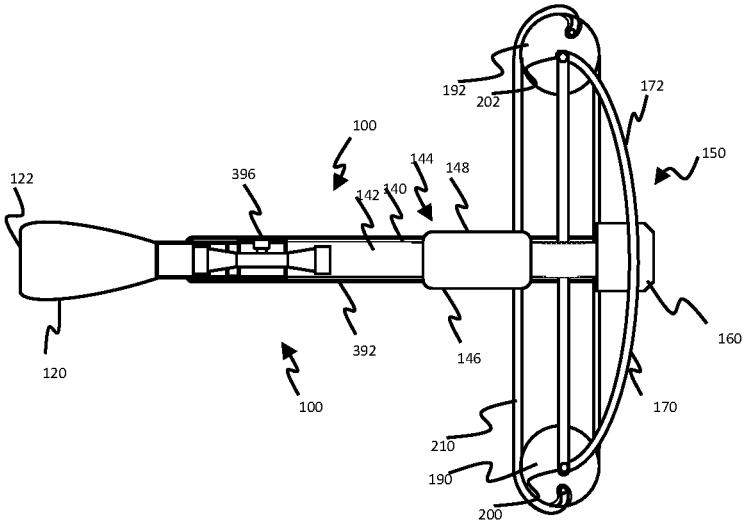
FIG. 7 shows an embodiment of a crossbow with the firing grip adapter and the foregrip adapter therebetween.

In embodiments crossbow 100 may be used in combination with first adapters 330 and 380 having a linkage such as linkage 390 arranged between first firing grip adapter 330 and first foregrip adapter 380 one embodiment of which is shown in FIG. 7. Linkage 390 can be used to allow integration of the functions of first adapters 330 and 380, in accordance with the paradigm associated with first adapters 330 and 380 such as by providing mechanical, electrical or optical linkages between first adapters 330 and 380 and optionally by providing surfaces such as surfaces 392, 394 and 396 shaped and sized to extend along barrel 140 to provide separation between barrel 140 and other objects, to provide gripping surfaces, mountings, storage areas, to provide coloration or camouflage and the like. As is also shown in FIG. 7, in embodiments, first adapters 330 and 380 may also support additional surfaces 394 and 398 which join to first adapters 330 and 380 on opposite sides of crossbow 100.

In embodiments such as the embodiment of FIG. 7, linkage 390 may provide a pathway 312 to which first firing grip crossbow accessory subsystem 338 in first firing grip adapter 330 can be connected. Pathway 312 is connected to first foregrip crossbow accessory subsystem 388 to enable transfers of electrical, mechanical, optical, chemical, or other forms material, energy or other forms of transactions between first firing grip crossbow accessory subsystem 338 and first foregrip crossbow accessory subsystem 388. Such transactions may share material, chemical reactants, data, control and power signals.

In embodiments, either of first adapters 330 and 380 may provide a first firing grip crossbow accessory subsystem 338 or first foregrip crossbow accessory subsystem 338 having user interfaces including for example and without limitations buttons, dials, switches, contact sensors, proximity sensors, vibration sensors, thermal sensors, magnetic sensors, Hall effect sensor or any other sensors that may sense a presence of a hand of a user or specific pressure or presence of any part of a user's body within a range of detection, or to detect a user input action such as moving a part of a body in a predetermined fashion that is intended to initiate, terminate or adjust a feature, property of, setting of or operation of crossbow 100, any accessory of crossbow 100, or any electronic, magnetic, electro-magnetic or optical circuit or system associated with either first firing grip crossbow accessory subsystem 338 or first foregrip crossbow accessory subsystem 338. In one non-limiting example of such an embodiment, an accessory subsystem such as first foregrip crossbow accessory subsystem 338 may detect particular user input actions intended to control a zoom setting of an sighting system 124 such as a scope and to cause a zoom setting of sighting system 124 to change in response thereto such as by transmitting a wireless signal that can be received at aiming device 124 to cause sighting system 124 to change a zoom setting. In other embodiments, aiming device 124 can be connected to pathway 312 so that control signals of any type that can be conveyed by way of pathway 312 can be transmitted to aiming device 124. It will be appreciated that adapters such as adapters 330, 350, 380 and 400 can include other sensors including but not limited to vibration sensors, presence sensors, pressure sensors, orientation sensors and other known forms of sensors.

In embodiments, first firing grip subsystem 338 and first foregrip subsystem 388 may be adapted with sensors capable of determining the existence and nature of a user's a grip on both of first firing grip adapter 350 and first foregrip adapter 380 and to make control determinations based upon the existence of and/or the nature of the two grips or to provide signals indicative the detection state at first firing grip adapter 330 and first foregrip adapter 380 to other control systems in crossbow 100 or to other devices such as by way of wireless transmission which may be incorporated at least in part into any of pathway 312, first firing grip subsystem 338 and first forearm grip subsystem 388.

Figure 8:
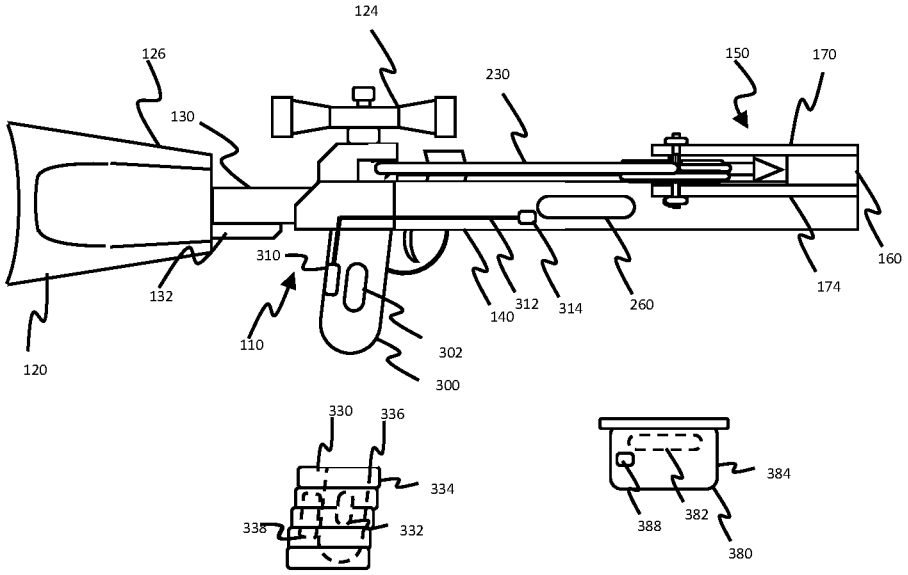
FIG. 8 shows another embodiment of a crossbow adapted for use with a firing grip adapter and a foregrip adapter.

Similarly, in the embodiment of FIG. 8, crossbow 100 is shown having a first firing grip mount 302 to which first firing grip crossbow accessory subsystem 338 can be connected when first firing grip adapter 330 is mounted to firing grip mounting 302. In this embodiment, pathway 312 is connected to and provides a path to which a foregrip connector 314 is connected. Foregrip connector 314 is positioned proximate to foregrip mounting 360. Foregrip connector 314 is positioned so that it will interact with first foregrip crossbow accessory subsystem 388 to enable transfers of electrical, mechanical, optical, chemical, or other forms material, energy or other forms of transactions between first firing grip crossbow accessory subsystem 338 and first foregrip crossbow accessory subsystem 388. Such transactions may exchange material, chemical reactants, data, control and power signals to enable cooperation or independent action by either or both of first firing grip crossbow accessory subsystem 338 and first foregrip crossbow accessory subsystem 388.

In embodiments, first firing grip crossbow accessory subsystem 338 and first foregrip crossbow accessory subsystem 388 can cooperate to provide aiming assistance such as by cooperating to emit light for illumination or for providing targeting spot or other indicia with such light being in the visible or non-visible bands, to enable activation or deactivation of communications circuits, tracking circuits, video displays, computers and electronic controllers, including but not limited to devices that help predict a trajectory of the crossbow arrow 230 given current orientation, environmental conditions and characteristics of the bolt loaded therein and controllers that determine operation of crossbow 100. Such subsystems may also allow adjustment of firing or aiming parameters, or other parameters related to the cocking, loading, firing or de-cocking of crossbow 100.

In embodiments, crossbow 100 may be adapted such that crossbow 100 is usable without either of first firing grip adapter 330 and first foregrip adapter 380 such as by providing a firing grip mounting frame 300 and foregrip mounting 360 that are configured both for direct gripping and to which first firing grip adapter 330 and first foregrip adapter 380 can mount so as to enable a first paradigm and with crossbow 100 which is different from a second set of interactive activities that can be performed with crossbow 100 without first firing grip adapter 330 and first foregrip adapter 380 attached.

In embodiments, firing grip mount 302 can mount to firing grip mounts 332 and 352 and foregrip mounting 360 can mount to forearm grip mounts 382 and 402 using pins, inserts, fasteners, plugs and sockets, straps, surrounds, wraps, through holes and through hole connectors as well as magnetic and electromagnetic means, and can also mount using adhesives.

It will be appreciated that what is provided herein is an adaptive crossbow system that can be readily adapted to a particular use without necessarily modifying crossbow 100. It will also be appreciated that the principled described herein may be extended to other areas of crossbow 100 to which a user may come into contact such that combinations including optionally providing a crossbow 100 with a stock 120 that has a cheek pad mounting similar to what has been described for firing grip mounting 302 or foregrip mounting 360 to enable adaptation of this surface of crossbow 100 in accordance with the predetermined first predetermined use paradigm or with the second predetermined use paradigm. It will also be appreciated that the principles described herein may be applied to other areas of crossbow 100 with a stock 126 having a butt 122 with a mounting to which at least a first and a second butt can be mounted, similar to what has been described with respect to firing grip mounting 302 or foregrip mounting 360, to enable adaptation of this surface of crossbow 100 in accordance with a predetermined first or second paradigm.

Although the inventions have been described in connection with preferred embodiments, it should be understood that various modifications, additions and alterations may be made by one skilled in the art without departing from the spirit and scope of the inventions described herein.

What is claimed is:

1. A crossbow system comprising:

a barrel joined to a frame;

a bow and string positioned along the barrel;

a firing system having a firing grip area with a trigger and a string capture and fire control system positioned apart from the bow and string along the barrel;

a firing grip mounting frame having a firing grip mounting shaped and adapted for use with one of a first firing grip adapter having a firing grip adapter mounting configured to mount to the firing grip adapter mounting and a second firing grip adapter having a second grip adapter mounting configured to mount to the firing grip adapter mounting;

a foregrip mounting between the firing grip and the bow and having a foregrip mounting shaped and adapted for use with one of a first foregrip adapter having a first foregrip adapter mount configured to mount to the foregrip mounting and a second foregrip grip adapter having a second foregrip adapter mount configured to mount to the foregrip mounting;

wherein the first grip adapter has an interaction surface positioned relative to the firing grip mounting by a first grip adapter frame according to a first predetermined functional paradigm and the second grip adapter has an interaction surface positioned relative to the firing grip mounting by a second grip adapter frame according to a second predetermined functional paradigm; and wherein the first foregrip adapter has an interaction surface positioned relative to the first foregrip adapter mount by a first foregrip adapter frame according to the first predetermined functional paradigm and the second foregrip adapter has an interaction surface positioned relative to the second foregrip adapter mount by a second foregrip adapter frame according to the second predetermined functional paradigm.

2. The crossbow system of claim 1, wherein the first firing grip adapter and the first foregrip adapter are configured to mount to the crossbow to support the first functional paradigm of a first use of the crossbow system when mounted thereto and the second firing grip adapter and the second foregrip adapter are configured to support a second functional paradigm of a second use of the crossbow system when mounted thereto.

3. The crossbow system of claim 1, wherein the first functional paradigm adapts the crossbow for use within a first the range of motions and the second functional paradigm adapts the crossbow for use within a second range of motions.

4. The crossbow system of claim 1, wherein the first functional paradigm is use of the crossbow by a person of a first level ability and the second functional paradigm is use of the crossbow by a second level of ability.

5. The crossbow system of claim 1, wherein the first functional paradigm is use of the crossbow by a person having a first size and the second functional paradigm is use of the crossbow by a person of a second size.

6. The crossbow system of claim 1, wherein the first functional paradigm is providing a first visual appearance and the second functional paradigm providing a second visual appearance.

* * * * *